United States Patent [19]

Brown

[11] 3,993,382

[45] Nov. 23, 1976

[54] MOISTURE SEAL FOR ELECTRICAL INTERCONNECT SYSTEM

[75] Inventor: Elvin E. Brown, Cedar Rapids, Iowa

[73] Assignee: Rockwell International Corporation, El Segundo, Calif.

[22] Filed: Dec. 10, 1971

[21] Appl. No.: 206,831

[52] U.S. Cl. ..... 339/17 LC; 339/192 R

[51] Int. Cl.[2] ..... H05K 1/02

[58] Field of Search ..... 339/17 R, 17 D, 17 F, 339/17 L, 17 LM, 17 LC, 17 M, 18 R, 31–33, 36, 59–63, 65, 66, 93, 94, 103, 111, 113, 125, 192, 156, 176, 206, 207, 217, 258

[56] References Cited

UNITED STATES PATENTS

| | | | |
|---|---|---|---|
| 2,613,244 | 10/1952 | Del Camp | 339/17 D |
| 3,439,316 | 4/1969 | Evans | 339/258 R |
| 3,697,933 | 10/1972 | Black et al. | 339/192 R |

*Primary Examiner*—Roy D. Frazier
*Assistant Examiner*—Terrell P. Lewis
*Attorney, Agent, or Firm*—Bruce C. Lutz; Robert J. Crawford

[57] ABSTRACT

Disclosed in an electrical interconnect system for electrically interconnecting printed circuit component boards. Each component board has mounted thereon an elongated dielectric housing which contains within housing cavities two rows of electrical sockets, the sockets of one row having integral tabs extending over the sockets of the inner row to make electrical connection with circuitry on the board. A resilient seal is provided between the tabs and the inner row sockets to assure moisture isolation and electrical isolation therebetween.

1 Claim, 4 Drawing Figures

MOISTURE SEAL FOR ELECTRICAL INTERCONNECT SYSTEM

This invention relates to electrical interconnect systems for interconnecting printed circuit boards and more particularly relates to means for providing a moisture seal and electrical insulation between contacts of the system.

For the past several years, numerous techniques have been developed for detachably electrically interconnecting printed circuit component boards by mounting on each of the component boards a connector having contacts adapted to mate with corresponding contacts which are mounted on a printed circuit interconnect board or, as sometimes referred to, a side board or a mother board. Such interconnect systems are well known as exemplified by copending U.S. Pat. Application No. 92,772, filed Nov. 25, 1970, and copending U.S. Pat. Application No. 198,920, filed Nov. 15, 1971, both assigned to the assignee of this invention, and by U.S. Pat. No. 3,270,251.

Because of the high density and corresponding close proximity of the electrical contacts in the connector mounted on the component board, the application of these interconnect systems in environments subject to high humidity and temperature variations produces the possibility of the formation of a moisture film between contacts which lowers the insulation resistance and jeopardizes complex circuit operations. The aforementioned U.S. Pat. application No. 198,920 particularly solves the problem at the interface between the connectors mounted on the printed circuit component board and the corresponding contacts mounted on the printed circuit component board. However, in those applications where the printed circuit component board is mounted perpendicular to the interconnect board, there is also a possibility of a short between adjacent contacts on the component board at the ends of the contacts which are farthest removed from the interconnect board. It is therefore an object of the invention to provide an interconnect system of the type described with an insulating arrangement to prevent electrical shorting between adjacent contacts which are mounted on printed circuit component boards.

In a preferred embodiment of the invention, a printed circuit interconnect board is disclosed having a plurality of electrical male connecting pins perpendicularly extending therefrom. A printed circuit component board has mounted thereon one or more connectors, each of which is comprised of an elongated dielectric contact housing containing a plurality of spaced electrical female sockets each adapted to receive one of said male pins. The sockets are so arranged in the housing that there is an inner row of contacts adjacent to the component board, and an outer row of sockets each socket of which has one of the sockets of the inner row located between it and the component board. The outer row socket has an integral tab extending through an opening in the dielectric housing and inserted in a plated through hole in the printed circuit component board to make electrical contact therewith. A resilient insulator is located between each tab of the outer row and a female socket of the inner row to provide a moisture and electrically insulating seal therebetween.

The invention will be better understood from a reading of the following specification with reference to the accompanying drawings in which:

FIG. 2(*b*) is a pictorial view of a second embodiment of the moisture seal and insulator of the invention.

Figure 1:
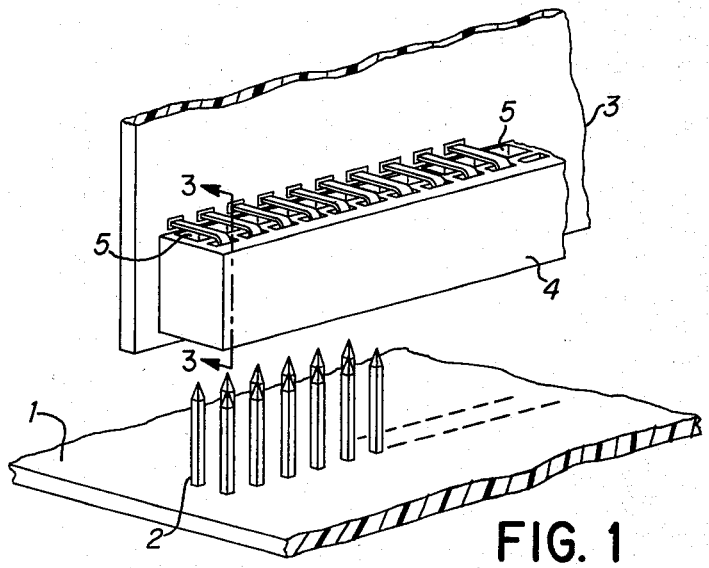
FIG. 1 (PRIOR ART)
FIG. 1 is a pictorial view of the electrical interconnect system of the prior art.

The interconnect system of the prior art to which this invention is uniquely applicable is illustrated in FIG. 1. An interconnect or mother board 1 has male connecting pins 2 extending perpendicularly therefrom. In usual practice the board 1 is of the multilayer variety and the pins 2 are interconnected to the various circuits on the board via plated through holes in the board. Printed circuit component board 3 has mounted thereon connector 4 of the dielectric material. As is well known in the prior art, the connector 4 has a plurality of cavities having female socket members 11 (see FIG. 3) inserted therein. Each socket is adapted to receive and electrically connect with one of the male pin members 2. The sockets of the inner row of cavities; i.e., the row of cavities closest to the board 3, are each inserted into the cavities through the openings 5. Each of the sockets has an integral extension 6 (see FIG. 3) opposite the opening 5 which is bent over and inserted through a plated through hole in the board and soldered to make electrical contact with the circuitry therein.

The sockets of the outer row of cavities are each inserted into the cavities through the openings 7. Each of the sockets of the outer row has an integral extension 8 which is bent over and inserted through a plated through hole in the component board and soldered to make electrical contact with the circuitry therein. As will be apparent from a consideration of FIG. 1, the extensions 8 each lie over an opening 5 of the inner row of contacts. In actual practice, where the contacts of the inner row are spaced apart on one tenth inch centers, the spacing between the extensions 8 and the tops of the contacts located in the cavities in the inner row is approximately 0.050 inch. The possibility exists for short circuits to occur between the tabs 8 and the sockets of the inner row, particularly in high humidity environments where moisture may form on the walls of the opening 5 to bridge the gap between the tabs and sockets. Accordingly, applicant has devised a resilient dielectric seal which is uniquely structured to provide a moisture and electrically insulating seal between the tabs 8 and the sockets of the inner row of cavities.

Figure 2A:
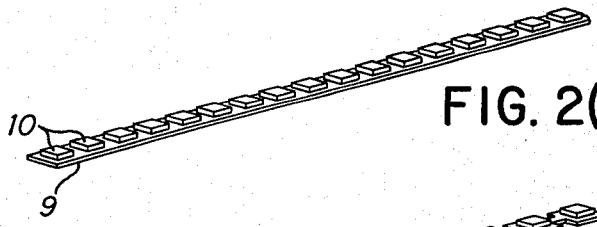
FIG. 2(*a*) is a pictorial view of one embodiment of the moisture seal and insulator of the invention.
Figure 2B:
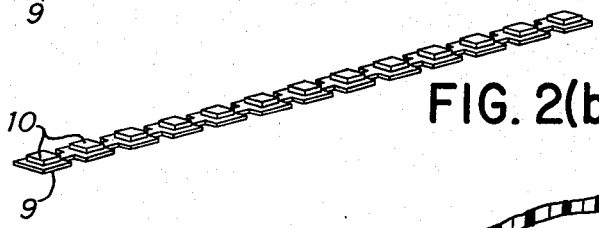
Figure 3:
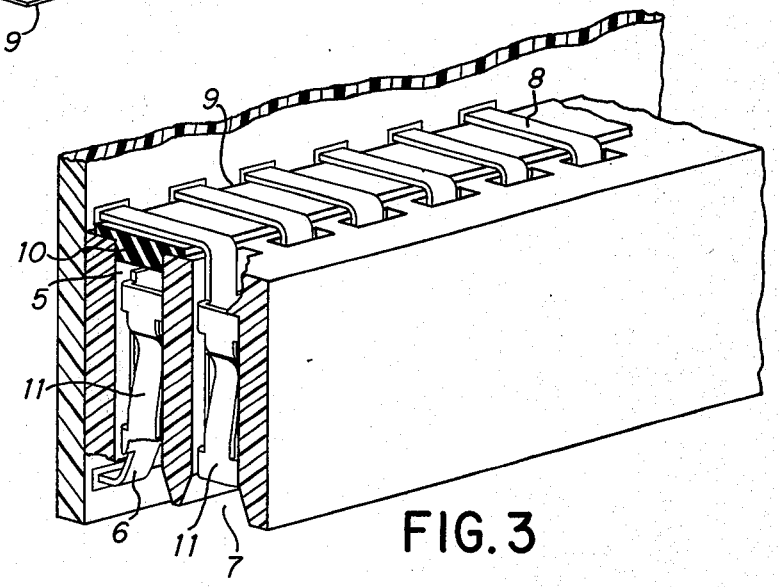
FIG. 3 is a partial pictorial view of the interconnect system of this invention employing the seal of FIG. 2(*a*).

FIGS. 2(*a*) and 2(*b*) illustrate two preferred embodiments of the seal. In each instance carrier strip 9 carries integral spaced apart projections 10 which are shaped to fit within the opening 5 of the inner row. The seal is preferably a resilient soft rubber, such as defined in Mil Standard 471, Type FD, Grade 50. The spacing of the projections 10 is identical to the spacing of the opening 5 in the inner row so that each projection fits within one of the cavities. Referring to FIG. 3, wherein the connector 4 is shown partially broken away, the projection 10 of the seal of FIG. 2(*a*) is shown inserted in the opening 5 of the first cavity in the row. It will be noted that the carrier strip 9 rests against the top surface of the connector 4. The tabs 8 bend over the seal and apply pressure thereto to form a moistureproof seal between the tabs 8 and the openings 5.

The interconnect system of this invention, particularly when utilized with the moisture seal arrangement disclosed in the aforementioned U.S. Pat. application No. 198,920, provides a failproof interconnect system for highly complex printed circuit boards in the most extreme of environments.

I claim:

1. An electrical interconnect system comprising: a printed circuit board; an elongated dielectric housing mounted on said board and having an inner and outer row of cavities therein; a plurality of electrical contacts located within cavities in said inner row, each said contact of said inner row having an integral part thereof extending from a first side of said housing and electrically connected to circuitry on said board; a plurality of electrical contacts located within said cavities in said outer row, each contact having an integral tab extending from a second side of said housing opposite said first side, said tab overlying one of the cavities in said first row and electrically connected to circuitry on said board; and a resilient electrical insulator, comprised of a carrier strip of resilient soft rubber having integral projections thereon which extend into each of the cavities of said inner row, compressed between said tab and said second side of said connector to provide a moisture seal and electrical insulator between said tab and the contact in the cavity underlying said tab.

* * * * *